US006139063A

United States Patent [19]

Purcocks

[11] Patent Number: 6,139,063

[45] Date of Patent: Oct. 31, 2000

[54] STATIONERY FOLDER

[76] Inventor: Dale McPhee Purcocks, 11 Alma Court, Alma Road, Monkstown, County Dublin, Ireland

[21] Appl. No.: 09/135,706

[22] Filed: Aug. 18, 1998

[30] Foreign Application Priority Data

Nov. 29, 1997 [GB] United Kingdom ..... 9725217
Apr. 3, 1998 [GB] United Kingdom ..... 9807197

[51] Int. Cl.[7] ..... B42D 1/00

[52] U.S. Cl. ..... 281/21.1; 281/15.1; 281/29; 281/46

[58] Field of Search ..... 281/15.1, 21.1, 281/29, 36, 37, 46

[56] References Cited

U.S. PATENT DOCUMENTS

| | | | |
|---|---|---|---|
| 3,957,287 | 5/1976 | Hall et al. | 281/29 |
| 4,007,950 | 2/1977 | Giulie . | |
| 4,402,585 | 9/1983 | Gardlund | 353/120 |
| 4,697,970 | 10/1987 | Hanson | 281/29 |
| 4,928,995 | 5/1990 | Pickering et al. | 281/29 |
| 5,025,978 | 6/1991 | Pacione . | |
| 5,052,872 | 10/1991 | Hunder et al. | 281/51 |
| 5,601,312 | 2/1997 | Funkhouser . | |

FOREIGN PATENT DOCUMENTS 2277716 9/1994 United Kingdom .

*Primary Examiner*—A. L. Wellington
*Assistant Examiner*—Monica Carter
*Attorney, Agent, or Firm*—Rodman & Rodman

[57] ABSTRACT

The folder comprises:

(a) a jacket member comprising a front cover sheet and a back cover sheet and having at least one substantially median spinal fold intermediate between the front cover sheet and the back cover sheet;

(b) at least one flap member affixed to the jacket member, the flap member being movable from a retracted position in which access is permitted to at least a margin of the back cover sheet adjacent the spinal fold and to at least a margin of the front cover sheet adjacent the spinal fold, to a covering position in which the flap member covers at least the margins; and (c) adhesive means for bonding the flap member in the covering position.

16 Claims, 2 Drawing Sheets

STATIONERY FOLDER

BACKGROUND OF THE INVENTION

The present invention relates to a folder for stationery or the like.

There are many different types of folders (sometimes referred to as file covers or the like) available for containing and presenting sheets of paper or the like. Such folders generally have jackets (typically with front and back cover sheets) within which paper or the like may be held, typically by securing means such as clips, rings, slides, plastics combs or adhesive bonding agents. Such securing means are generally highly visible and tend to look unsightly and unprofessional for presentation folders or the like. Furthermore, the securing means in some such folders of the prior art have the disadvantage that they do not always reliably secure all the contents of the folder.

Prior art document U.S. Pat. No. 5,601,312 discloses a two-piece cover for binding a plurality of sheets. The front cover panel and the rear cover panel are formed of separate panels which are assembleable by securing the front cover panel to a stack of sheets by securing means. The rear cover panel includes an adhesive strip which adheres to the stack of sheets. A flap portion of the rear cover panel is then folded such that an adhesive strip thereon may secure the flap portion to the front cover panel so as to cover the securing means.

OBJECTS OF THE INVENTION

It is therefore an object of the present invention to provide an improved folder for stationery or the like.

It is a further object of the invention to provide an improved folder having a flap member which may provide access to a front margin and to a back margin of the folder.

It is also an object of the invention to provide a folder having a flap member which is movable to a position in which fastening means present in the margin region of the folder may be covered.

SUMMARY OF THE INVENTION

The present invention provides a folder which comprises:

(a) a jacket member comprising a front cover sheet and a back cover sheet and having at least one substantially median spinal fold intermediate between the front cover sheet and the back cover sheet;

(b) at least one flap member affixed to the jacket member, the at least one flap member being movable from a retracted position in which access is permitted to at least a margin of the back cover sheet adjacent the spinal fold and to at least a margin of the front cover sheet adjacent the spinal fold, to a covering position in which the at least one flap member covers at least the margins; and (c) adhesive means for bonding the at least one flap member in the covering position.

DESCRIPTION OF PREFERRED EMBODIMENTS

It is preferred that the margins adjacent the spinal fold comprise a durable but penetrable material (penetrable by staples or the like).

Flexible sheet material (such as paper or the like) may be inserted into the folder such that an edge region of the sheet material is positioned alongside the interior of the spinal fold. The flexible sheet material may be secured in the folder by fastening means (such as staples or the like) applied substantially along the margins of the cover sheets and through the edge region of the sheet material, for example, using a stapling machine. The one or more flap members may then be moved from the retracted position to the covering position so as to cover at least the front and back margins of the cover sheets and any staple or staples (or other fastening means) which might otherwise be visible.

The jacket member forming part of the folder according to the present invention preferably comprises a unitary sheet of durable material (such as a suitable plastics material).

According to one embodiment of the present invention, the jacket member may have two or more substantially median spinal folds, so as to form a spinal gusset between the front cover sheet and the back cover sheet. Such a gusset defines a space therebetween for receiving an edge region of a stack of sheet material. This arrangement permits more sheet material and/or thicker sheets to be secured in the folder than in the arrangement in which one spinal fold is present.

A range of folders according to the present invention may be produced with a corresponding range of spacings between such spinal folds. The size of the staples or other fastening means used may also be selected according to the number of, or thickness of, sheets to be secured in the folder.

In a preferred embodiment of the present invention, the folder includes at least one crease line spaced from, and substantially parallel to, the spinal fold. Preferably, the crease line is formed on the front cover sheet so that the contents of the folder may be viewed by folding the front cover sheet along the crease line. Typically, the crease line defines the border of the margin of the front cover sheet adjacent the spinal fold. Alternatively, there may be two crease lines, one at either side of the spinal fold (in other words, there may be a crease line on both the front and back cover sheets).

The flap member of the folder according to the present invention preferably comprises an elongate length of material, and is preferably of similar or same material as that of the jacket member. At least part of the flap member is affixed to the jacket member. The flap member is preferably opaque such that when the flap member is in the covering position, the margins, the spinal fold and any fastening means present along the margins are not visible through the flap member.

In one embodiment of the present invention, the flap member may comprise a first long edge which is permanently affixed to the front or back cover sheet and spaced apart from the margin of the front or back cover sheet (leaving both margins readily accessible), and a second long edge which comprises adhesive means for use when bonding the flap member to the jacket member.

The first long edge of the flap member is preferably permanently affixed to the jacket member by suitable (permanent) adhesive means, by welding or the like. The second long edge of the flap member comprises suitable adhesive means, such adhesive means being preferably of a permanent nature. Alternatively, the adhesive means may be such as to permit removable bonding of the flap member to the jacket member, thereby allowing the folder to be re-used.

The second long edge of the flap member may additionally comprise a strip of paper or the like covering the adhesive means. This strip may be removed (for example, peeled off) prior to moving the flap member from the retracted position in which access is permitted to both margins of the front and back cover sheets, to a covering position in which the flap member is adhesively attached to the jacket member and covers both margins of the front and back cover sheets. In the covering position, the second long edge of the flap member may be adhesively bonded to the margin, or to a portion of the respective cover sheet spaced from the margin.

According to another embodiment of the present invention, the first and second long edges of the flap member may comprise suitable adhesive means, and a substantially median portion of the flap member may be permanently affixed to the spinal fold of the jacket member substantially parallel to the two long edges of the flap member.

According to a further embodiment of the present invention, the folder may comprise two such flap members, with the first long edge of one flap member being permanently affixed to the front cover sheet and the first long edge of the other flap member being permanently affixed to the back cover sheet. The first long edge of each such flap member is bonded to the respective cover sheet, but not to the respective margin, thereby leaving both margins accessible. The second long edge of each flap member typically comprises suitable adhesive means.

The folder according to the present invention may be used with paper binders, clips, slides or the like, as fastening means in place of staples (all of which are preferably such that they penetrate the margins). Such a paper binder, clip or slide may then be hidden, as previously described, by covering the margins of the front and back cover sheets with the flap member.

The folder according to the present invention permits access to both margins of the front and back cover sheets at the same time, so that, advantageously, fastening means (such as staples applied by a stapling machine) may be effectively used to fasten sheet material to both margins in one operation. Additional staples may be used to further secure the sheet material to the jacket member.

In a preferred embodiment of the present invention, the jacket member and the flap member are typically of suitable plastics material. It is further preferred that the front and/or back cover sheets may be transparent. Alternatively, a portion only of the front and/or back cover sheets may be transparent, so as to form a window or the like.

DETAILED DESCRIPTION OF THE DRAWINGS

Figure 1:
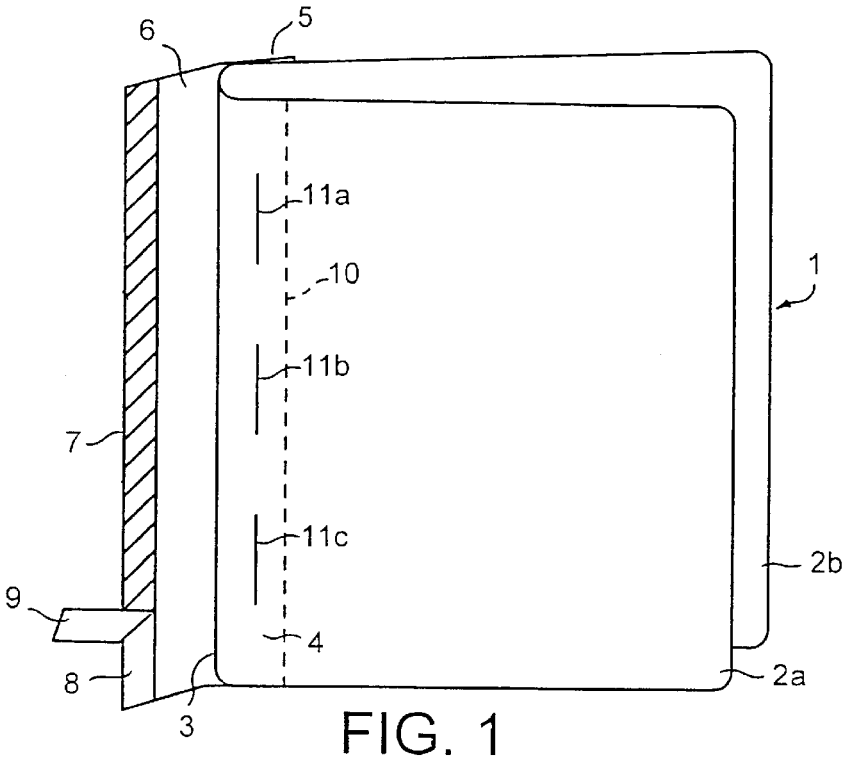
FIG. 1 (not to scale) is a schematic representation of one embodiment of folder according to the present invention, with a flap member permanently affixed to the jacket member.

Referring to FIG. 1, there is illustrated a folder generally designated by reference numeral 1. The folder 1 comprises a unitary jacket member 2 comprising a front and back cover sheet 3*a*,3*b* and having a substantially median spinal fold 4. The front cover sheet 3*a* has a margin 5 adjacent the spinal fold; the back cover sheet 3*b* also has a margin adjacent the spinal fold (not shown in the diagram). A first long edge 7 of elongate flap member 6 is permanently bonded to the back cover sheet 3*b* and spaced from the margin border.

A second long edge 8 of flap member 6 has an adhesive coating to bond the flap member 6 in the covering position to the front cover sheet 3*a*. In the covering position the second long edge 8 is bonded within margin 5 or spaced from margin 5, so that the margins of the front and back cover sheets 3*a*,3*b* are covered. The second long edge 8 has an adhesive coating 9 concealed by a peelable strip 10; prior to bonding the flap member 6 to the front cover sheet 3*a*, the peelable strip is removed. The front cover sheet 3*a* has a crease line 11 defining the border of margin 5, which permits the cover sheet 3*a* to be folded along the crease line 11 to reveal the contents of the folder 1.

When sheet material is to be secured in the folder, an edge region of the sheet material is aligned along the interior of the spinal fold. As illustrated in the diagram, the flap member 6 is in the retracted position, so as to permit access to both margins of the cover sheets 3*a*,3*b*, so that a stapling machine (for instance) may be used to fasten the sheet material to both margins of the cover sheets 3*a*,3*b*. In the arrangement shown in the diagram, three staples 12*a*,12*b*, 12*c* have been used to secure sheet material in folder 1. The flap member 6 may subsequently be bonded in the covering position.

Figure 2:
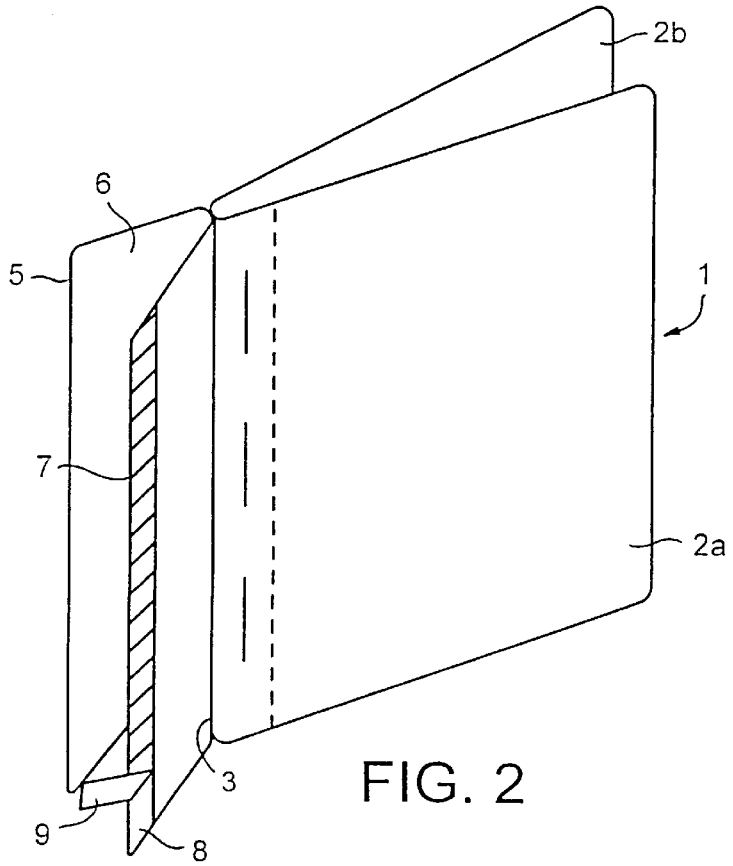
FIG. 2 is a schematic representation of another embodiment of folder according to the invention, with a substantially median portion of a flap member permanently affixed to the spinal fold of the jacket member.

Referring to FIG. 2, there is illustrated another embodiment of folder 1 in which a substantially median portion of flap member 6 is permanently bonded to spinal fold 4 of jacket member 2. The first and second long edges 7,8 of the flap member 6 are in a retracted position permitting access to both margins of cover sheets 3*a*,3*b*. The first and second long edges 7,8 comprise an adhesive coating 9 concealed by a peelable strip 10 (the strip is peeled away prior to use) to allow the first long edge 7 to be bonded to the front cover sheet 3*a* and the second long edge 8 to be bonded to the back cover sheet 3*b*. The long edges 7,8 are bonded within, or spaced from, the margins of the cover sheets 3*a*,3*b*.

Figure 3:
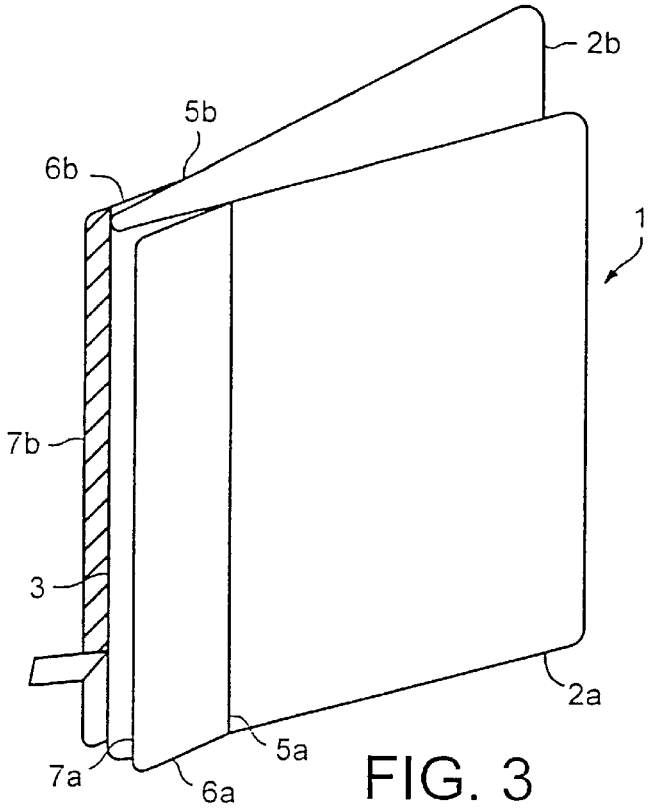
FIG. 3 is a schematic representation of another embodiment of folder according to the invention, with two flap members permanently affixed to the jacket member.

Referring to FIG. 3, there is illustrated a further embodiment of folder 1. The folder 1 comprises two flap members 6*a*,6*b*. Flap member 6*a* is permanently bonded to front cover sheet 3*a* along a first long edge 7*a*, and flap member 6*b* is permanently bonded to back cover sheet 3*b* along a first long edge 7*b*. The long edges 7*a*,7*b* are spaced apart from the margins. The second long edges 8*a*,8*b* of flap members 6*a*,6*b* comprise adhesive means to bond the flap members 6*a*,6*b* in the region of the spinal fold 4 to form the covering position.

Figure 4:
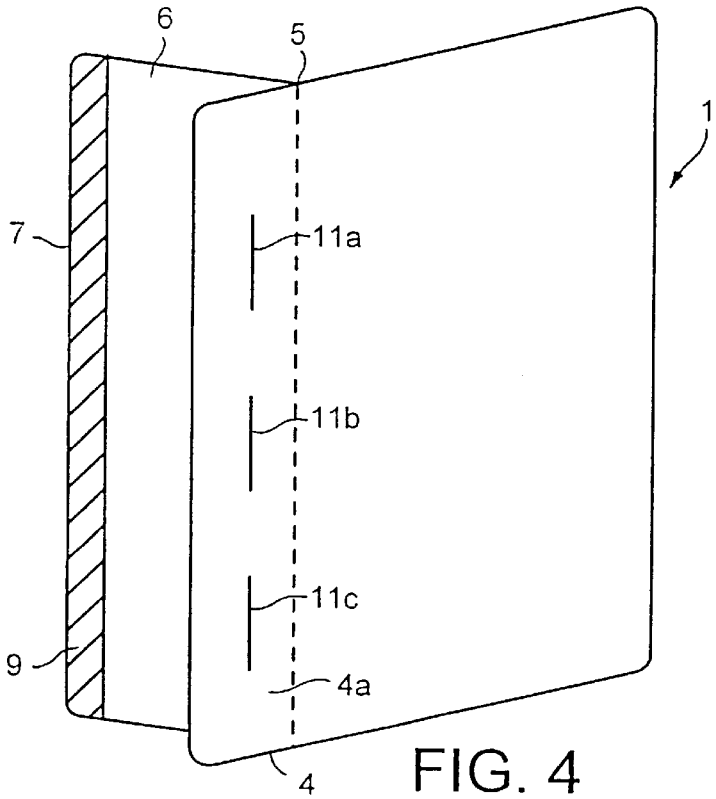
FIG. 4 is a schematic representation of the folder of FIG. 1 with the flap member in a covering position.

Referring finally to FIG. 4, there is illustrated a folder 1 in which the flap member 6 is in the covering position covering the margins of the cover sheets 3*a*,3*b*; because of the opacity of the flap member, the latter obscures staples 12*a*,12*b*,12*c*.

I claim:

1. A folder which comprises:

a) a jacket member comprising a front cover sheet and a back cover sheet joined by at least one substantially median spinal fold intermediate between said front cover sheet and said back cover sheet;

b) at least one flap member, separate from said front and back cover sheets, and affixed to said jacket member, said at least one flap member being movable from a retracted position in which access is permitted to at least a margin of said back cover sheet adjacent said spinal fold and to at least a margin of said front cover sheet adjacent said spinal fold to permit the application of fastening means on or through the margin of the back cover sheet and the margin of the front cover sheet, to a covering position in which said at least one flap member covers at least said margin of the back cover sheet and said margin of the front cover sheet and thereby covers the fastening means that are applied on or through the margin of the back cover sheet and the margin of the front cover sheet; and c) adhesive means for bonding said at least one flap member in said covering position to conceal the fastening means.

2. A folder according to claim 1, wherein at least one of said cover sheets has a crease line spaced from, and substantially parallel to, said spinal fold.

3. A folder according to claim 1, wherein said jacket member and said flap member are each of plastics material.

4. A folder according to claim 1, wherein at least a portion of at least one of said cover sheets is transparent.

5. A folder according to claim 1, wherein said flap member is opaque.

6. A folder according to claim 1, wherein said flap member comprises an elongate length of material with at least a part of said flap member permanently affixed to said jacket member, and at least one long edge having said adhesive means thereon.

7. A folder according to claim 6, wherein said adhesive means is such as to permanently bond said flap member to said jacket member.

8. A folder according to claim 7, wherein said adhesive means is covered by a peelable strip of paper.

9. A method of making a presentation folder, which comprises the steps of:

a) providing a folder according to claim 1;

b) inserting sheet material into said folder such that an edge region of said sheet material is substantially adjacent an interior of said spinal fold;

c) securing said front and back cover sheets and said sheet material about said margins by fastening means that are applied on or through said margins; and d) covering said margins and the fastening means that are applied on or through the margins with said flap member to conceal the fastening means.

10. A method according to claim 9, wherein said fastening means comprises at least one staple, paper binder, clip or slide which penetrates said margins.

11. A folder comprising, a) a foldable jacket member having, in a folded condition, a front cover, a back cover, a folded portion that defines a median spine, a front margin on said front cover adjacent said median spine, and a back margin on said back cover adjacent said median spine, b) a flap member separate from said back and front covers and having one portion joined to said jacket member proximate said median spine, said flap member having a first securable portion movable in one direction to a position away from said back margin to permit access to said back margin to permit the application of fastening means on or through said back margin, and moveable in the opposite of said one direction to a position against said back margin to cover the fastening means that are applied on or through said back margin, and a second securable portion movable in a second direction to a position away from said front margin to permit access to said front margin to permit the application of said fastening means on or though said front margin, and moveable in the opposite of said second direction to a position against said front margin to cover the fastening means that are applied on or through said front margin, and c) an adhesive on one of said back margin and the first securable portion of said flap member and on one of said front margin and the second securable portion of said flap member for bonding the first securable portion of said flap member in said position against said back margin and for bonding the second securable portion of said flap member in said position against said front margin to conceal the fastening means.

12. A folder as claimed in claim 11 wherein said one joined portion of said flap member is joined to a portion of the back cover that is spaced away from the back margin.

13. A folder as claimed in claim 11 wherein said one portion of said flap member is joined to said spine, said flap member having a second securable portion movable in a second direction away from said back margin to permit access to said back margin, and moveable in a second opposite direction to a position against said back margin, and an adhesive on one of said back margin and the second securable portion of said flap member for bonding the second securable portion of said flap member in said position against said back margin.

14. A folder as claimed in claim 11 wherein said one portion of said flap member is joined to one portion of the front margin at the front cover such that the first securable portion of said flap member is also movable towards said spine during positioning of said flap member against said front margin.

15. A folder as claimed in claim 14 including a second flap member joined to one portion of the back margin at the back cover and having a second securable portion movable in a second direction to a position away from said back margin to permit access to said back margin, and movable in a second opposite direction to a position against said back margin, and an adhesive on one of the back margin and the second securable portion of said second flap member for bonding said second securable portion of said second flap member in said position against said back margin.

16. A folder as claimed in claim 15 wherein said adhesive is on the first securable portion of the first flap member and on the second securable portion of the second flap member.

* * * * *